US011519131B2

(12) United States Patent
Lee et al.

(10) Patent No.: US 11,519,131 B2
(45) Date of Patent: Dec. 6, 2022

(54) CLOTHES CARE APPARATUS

(71) Applicant: SAMSUNG ELECTRONICS CO., LTD., Suwon-si (KR)

(72) Inventors: Hakjae Lee, Suwon-si (KR); Hyeonjoo Kim, Suwon-si (KR); Jaeryong Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 151 days.

(21) Appl. No.: 16/896,733

(22) Filed: Jun. 9, 2020

(65) Prior Publication Data

US 2020/0385917 A1 Dec. 10, 2020

(30) Foreign Application Priority Data

Jun. 10, 2019 (KR) ..... 10-2019-0067950

(51) Int. Cl.
*D06F 87/00* (2006.01)
*D06F 39/08* (2006.01)
*D06F 17/12* (2006.01)

(52) U.S. Cl.
CPC ..... *D06F 87/00* (2013.01); *D06F 17/12* (2013.01); *D06F 39/087* (2013.01)

(58) Field of Classification Search
CPC ..... D06F 87/00; D06F 17/12; D06F 39/087; D06F 58/203; D06F 73/02; D06F 58/10
See application file for complete search history.

(56) References Cited

U.S. PATENT DOCUMENTS 7,896,809 B2 * 3/2011 Simpson ..... A61B 5/1495 600/347
2007/0186593 A1 * 8/2007 Ahn ..... F22B 1/28 68/5 R (Continued)

FOREIGN PATENT DOCUMENTS

JP 2006-214997 8/2006
JP 2012-11208 1/2012

(Continued)

OTHER PUBLICATIONS

International Search Report dated Sep. 24, 2020 in International Patent Application No. PCT/KR2020/007205.

*Primary Examiner* — Michael E Barr
*Assistant Examiner* — Pallavi Chitta
(74) *Attorney, Agent, or Firm* — Staas & Halsey LLP

(57) ABSTRACT

Provided is a clothes care apparatus which includes: a main body including a care room accommodating clothes; a machine room positioned below the care room; and a steam generator positioned inside the machine room, and including a case and a water level sensor configured to sense a level of water stored in the case, wherein the water level sensor includes: a housing coupleable to and decoupleable from the case; a plurality of electrodes supported by the housing; and an electrode membrane including an electrode membrane body respectively surrounding each of the plurality of electrodes, and an electrode hole formed in the electrode membrane body to respectively expose the plurality of electrodes to an outside of the electrode membrane body, wherein the electrode hole is further spaced apart from one end of the electrode membrane body than from another end of the electrode membrane body.

18 Claims, 10 Drawing Sheets

(56) References Cited

U.S. PATENT DOCUMENTS

| | | | | |
|---|---|---|---|---|
| 2009/0107188 | A1* | 4/2009 | Park | D06F 39/008 68/5 R |
| 2010/0180465 | A1* | 7/2010 | Noviello | D06F 58/20 34/524 |

FOREIGN PATENT DOCUMENTS

| | | | | |
|---|---|---|---|---|
| KR | 10-2006-0082034 | | | 7/2006 |
| KR | 20060082034 | A | * | 7/2006 |
| KR | 10-2006-0100606 | | | 9/2006 |
| KR | 10-2011-0125984 | | | 11/2011 |

* cited by examiner

CLOTHES CARE APPARATUS

CROSS-REFERENCE TO RELATED APPLICATION

This application is based on and claims priority under 35 U.S.C. § 119 to Korean Patent Application No. 10-2019-0067950, filed on Jun. 10, 2019, in the Korean Intellectual Property Office, the disclosure of which is incorporated by reference herein in its entirety.

BACKGROUND

1. Field

The disclosure relates to a clothes care apparatus including a water level sensor configured to sense a level of water stored in a steam generator.

2. Description of the Related Art

A clothes care apparatus is equipment for caring for clothes, such as drying wet clothes, removing dust attached to clothes or smell permeated clothes, or smoothing out the wrinkles of clothes.

A clothes care apparatus includes a heat exchanger for supplying hot air to a care room in which clothes are accommodated to dry the clothes, and a steam generator configured to perform a refresh function, such as removing the wrinkles of clothes and the like, deodorization, removal of static electricity, etc.

The clothes care apparatus includes a main body forming the care room in which clothes are accommodated. A machine room in which the steam generator, the heat exchanger, etc. are installed is positioned below the care room. The machine room is separated from the care room.

The clothes care apparatus dries clothes accommodated in the care room through the heat exchanger included in the machine room, and humid air after drying the clothes is dehumidified by the heat exchanger and then again supplied to the care room.

The steam generator includes a case configured to accommodate water therein, and a water level sensor removably coupled to the case to sense a level of water stored in the case.

The water level sensor includes a housing removably coupled to the case, electrodes supported by the housing and contacting water stored in the case, and electrode membranes extending from the housing to surround the electrodes.

Generally, one ends of the electrodes are exposed to the outside of the electrode membranes to directly contact water stored in the case. Therefore, the exposed ends of the electrodes may be damaged, such as being bent or scratched, when the steam generator is distributed. Also, when the ends of the electrodes are exposed for a long time, rust may occur, which may shorten the life of the electrodes.

Furthermore, when water stored in the case is slopping, the slopping water contacts the exposed ends of the electrodes, which may cause a wrong operation of the water level sensor.

SUMMARY

In accordance with an aspect of the disclosure, a clothes care apparatus includes: a main body including a care room accommodating clothes; a machine room provided inside the main body and positioned below the care room; and a steam generator positioned inside the machine room, and including a case and a water level sensor detachably provided on the case and configured to sense a level of water stored in the case, wherein the water level sensor includes: a housing coupled to the case; a plurality of electrodes supported by the housing; and an electrode membrane including an electrode membrane body surrounding each of the plurality of electrodes, and an electrode hole formed in the electrode membrane body to expose the plurality of electrodes to an outside of the electrode membrane body, wherein the electrode hole is spaced from one end of the electrode membrane body or from the other end of the electrode membrane body.

One end of the electrode membrane may be connected to the housing to be integrated into the housing, and the other end of the electrode membrane may be spaced from a bottom of the case.

Lengths of the plurality of electrodes may be the same.

Each of the plurality of electrodes may include a first surface, a second surface being opposite to the first surface, a third surface connecting the first surface to the second surface, and a fourth surface being opposite to the third surface, and at least one of the first surface or the second surface may be exposed to the outside of the electrode membrane body through the electrode hole.

At least one of the third surface or the fourth surface may be surrounded by the electrode membrane body.

At least one of edges of the first surface or edges of the second surface may be surrounded by the electrode membrane body.

The plurality of electrodes may include a first electrode, and a second electrode being adjacent to the first electrode, and a position of a portion of the first electrode exposed to the outside of the electrode membrane body through the electrode hole may be different from a position of a portion of the second electrode exposed to the outside of the electrode membrane body through the electrode hole.

The electrode membrane body may include a first electrode membrane body surrounding the first electrode, and a second electrode membrane body surrounding the second electrode, and the electrode hole may include a first electrode hole formed in the first electrode membrane body and a second electrode hole formed in the second electrode membrane body, wherein the second electrode hole is spaced from the bottom of the case by a distance that is different from a distance by which the first electrode hole is spaced from the bottom of the case.

At least one of a third surface of the first electrode or a fourth surface of the second electrode, the third surface of the first electrode being opposite to the fourth surface of the second electrode, may be surrounded by the electrode membrane body to space apart the first electrode from the second electrode.

At least one of a fourth surface of the first electrode or a third surface of the second electrode may be exposed to the outside of the electrode membrane body through the electrode hole.

The first electrode may include a common electrode, and the second electrode may include a low water level electrode configured to sense a low water level of water stored in the case and a high water level electrode configured to sense a high water level of water stored in the case.

A distance by which the low water level electrode is spaced from the bottom of the case may be longer than a distance by which the common electrode is spaced from the bottom of the case.

The low water level electrode may be positioned above a heater configured to heat water stored in the case.

The second electrode may further include an intermediate water level electrode including an electrode hole exposed to the outside of the electrode membrane body between the electrode hole through which the low water level electrode is exposed to the outside of the electrode membrane body and the electrode hole through which the high water level electrode is exposed to the outside of the electrode membrane body.

The housing and the electrode membrane may be integrated into one body through insert-molding with the plurality of electrodes.

In accordance with another aspect of the disclosure, a clothes care apparatus includes: a main body including a care room; a machine room positioned below the care room; and a steam generator positioned inside the machine room, wherein the steam generator includes: a case; and a water level sensor including a housing detachably provided on the case, a plurality of electrodes configured to sense a level of water stored in the case, wherein one ends of the plurality of electrodes are supported by the housing, and an electrode membrane surrounding both ends of each of the plurality of electrodes, wherein one end of the electrode membrane is connected to the housing and the other end of the electrode membrane is spaced from a bottom of the case.

The electrode membrane may include an electrode membrane body surrounding each of the plurality of electrodes, and an electrode hole formed between one end of the electrode membrane body and the other end of the electrode membrane body to expose the plurality of electrodes to an outside of the electrode membrane body.

The plurality of electrodes may include a first electrode, and a second electrode being adjacent to the first electrode, and a position of the first electrode exposed to the outside of the electrode membrane body through the electrode hole is different from a position of the second electrode exposed to the outside of the electrode membrane body through the electrode hole.

The first electrode may include a common electrode, and the second electrode may include a low water level electrode configured to sense a low water level of water stored in the case, a high water level electrode configured to sense a high water level of water stored in the case, and an intermediate water level electrode exposed to the outside of the electrode membrane body between the electrode hole through which the low water level electrode is exposed to the outside of the electrode membrane body and the electrode hole through which the high water level electrode is exposed to the outside of the electrode membrane body.

In accordance with another aspect of the disclosure, a clothes care apparatus may include: a main body including a care room accommodating clothes; a machine room provided inside the main body and positioned below the care room; and a steam generator positioned inside the machine room, and including a case and a water level sensor detachably provided on the case and configured to sense a level of water stored in the case, wherein the water level sensor includes: a housing coupled to the case; a plurality of electrodes supported by the housing, and including a first electrode and a second electrode being adjacent to the first electrode; and an electrode membrane including an electrode membrane body surrounding at least one of one surface of the first electrode or one surface of the second electrode, the one surface of the first electrode being opposite to the one surface of the second electrode, to space apart the first electrode from the second electrode, and an electrode hole formed in the electrode membrane body and exposing at least one of another surface of the first electrode or another surface of the second electrode to an outside of the electrode membrane body.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
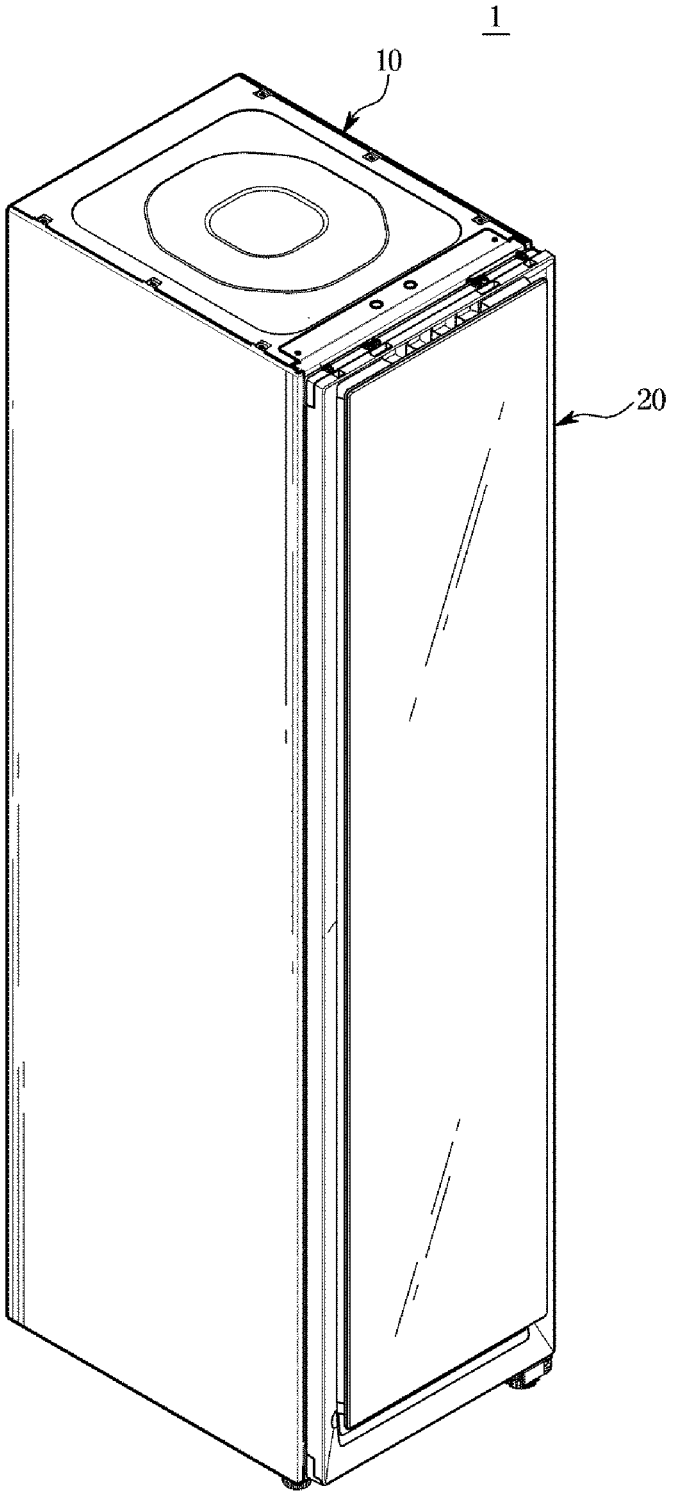
FIG. 1 is a perspective view of a clothes care apparatus according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are merely used to describe embodiments, and are not intended to limit and/or restrict the disclosure. An expression used in the singular encompasses the expression of the plural, unless it has a clearly different meaning in the context.

In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

Also, it will be understood that, although the terms "first", "second", etc., may be used herein to describe various components, these components should not be limited by these terms. The above terms are used only to distinguish one component from another.

For example, a first component discussed below could be termed a second component, and similarly, a second component may be termed a first component without departing from the scope of right of the disclosure. As used herein, the term "and/or" includes any and all combinations of one or more of the associated listed items.

In the following description, the terms "front", "rear", "upper", and "lower" are defined based on the drawings, and the shapes and positions of the corresponding components are not limited by the terms.

Throughout the disclosure, the expression "at least one of a, b or c" indicates only a, only b, only c, both a and b, both a and c, both b and c, all of a, b, and c, or variations thereof.

Therefore, it is an aspect of the disclosure to provide a clothes care apparatus including an improved water level sensor to prevent a wrong operation even when water stored in a case is slopping.

It is another aspect of the disclosure to provide a clothes care apparatus including an improved water level sensor to prevent a wrong operation even when a plurality of electrodes are located close to each other.

It is another aspect of the disclosure to provide a clothes care apparatus including an improved water level sensor to match lengths of a plurality of electrodes and share the plurality of electrodes.

Hereinafter, the embodiments of the disclosure will be described in detail with reference to the accompanying drawings.

Figure 2:
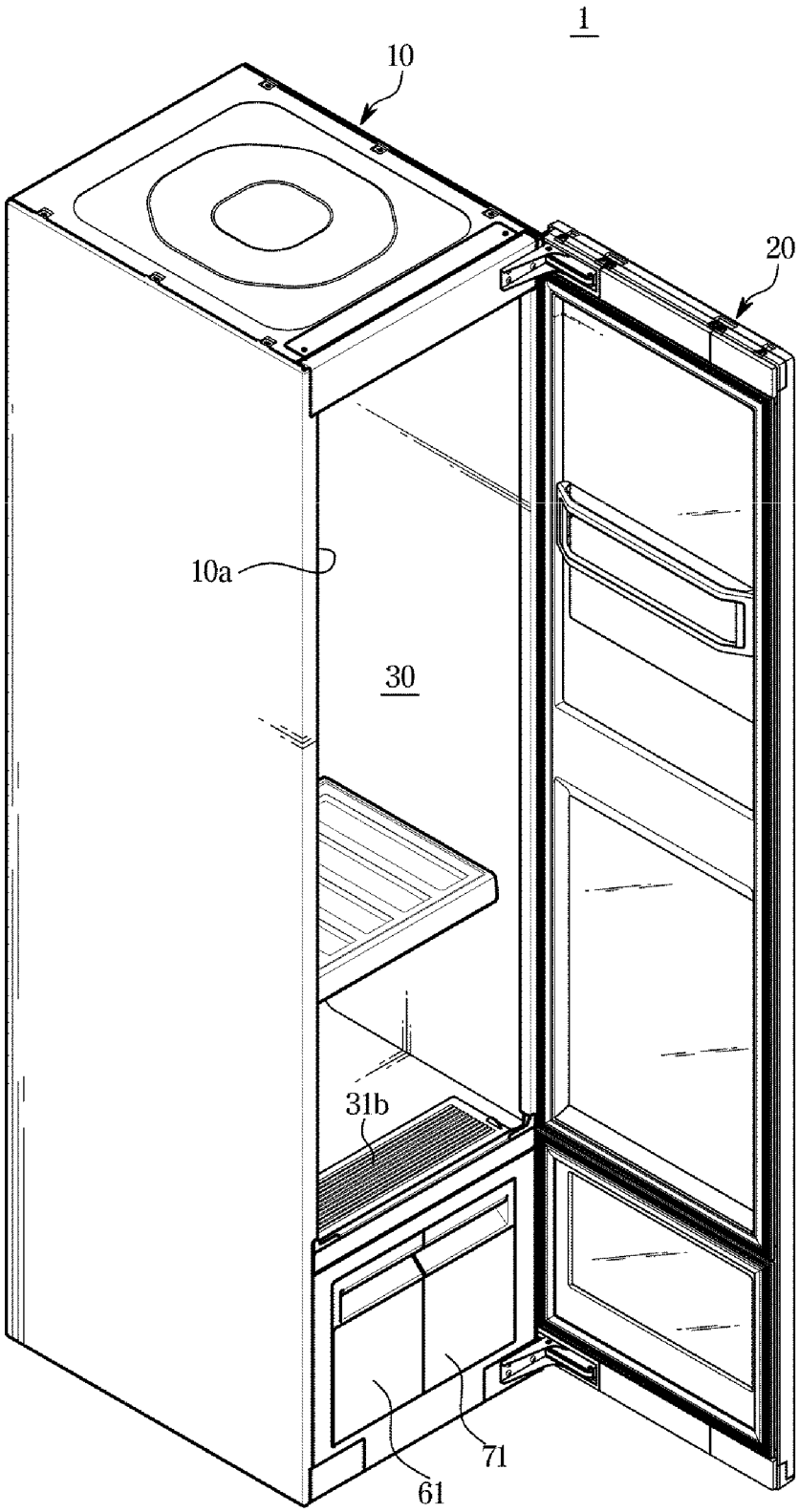
FIG. 2 shows a clothes care apparatus according to an embodiment of the disclosure when a door opens.

FIG. 1 is a perspective view of a clothes care apparatus according to an embodiment of the disclosure. FIG. 2 shows a clothes care apparatus according to an embodiment of the disclosure when a door opens.

As shown in FIGS. 1 and 2, a clothes care apparatus 1 may include a main body 10 forming an outer appearance of the clothes care apparatus 1, and a door 20 rotatably coupled to the main body 10.

The main body 10 may have a nearly hexahedral shape of which one side opens. In a front side of the main body 10, an opening 10*a* may be formed. The door 20 may be rotatably coupled to the main body 10 to open and close a care room 30.

Although not shown in the drawings, the door 20 may be installed in the main body 10 through a hinge, a link, etc.

The main body 10 may include the care room 30 provided inside the main body 10 to accommodate and care clothes. A front side of the care room 30 may open. The care room 30 may also be opened or closed by the door 20 that opens or closes the opening 10*a*.

Figure 3:
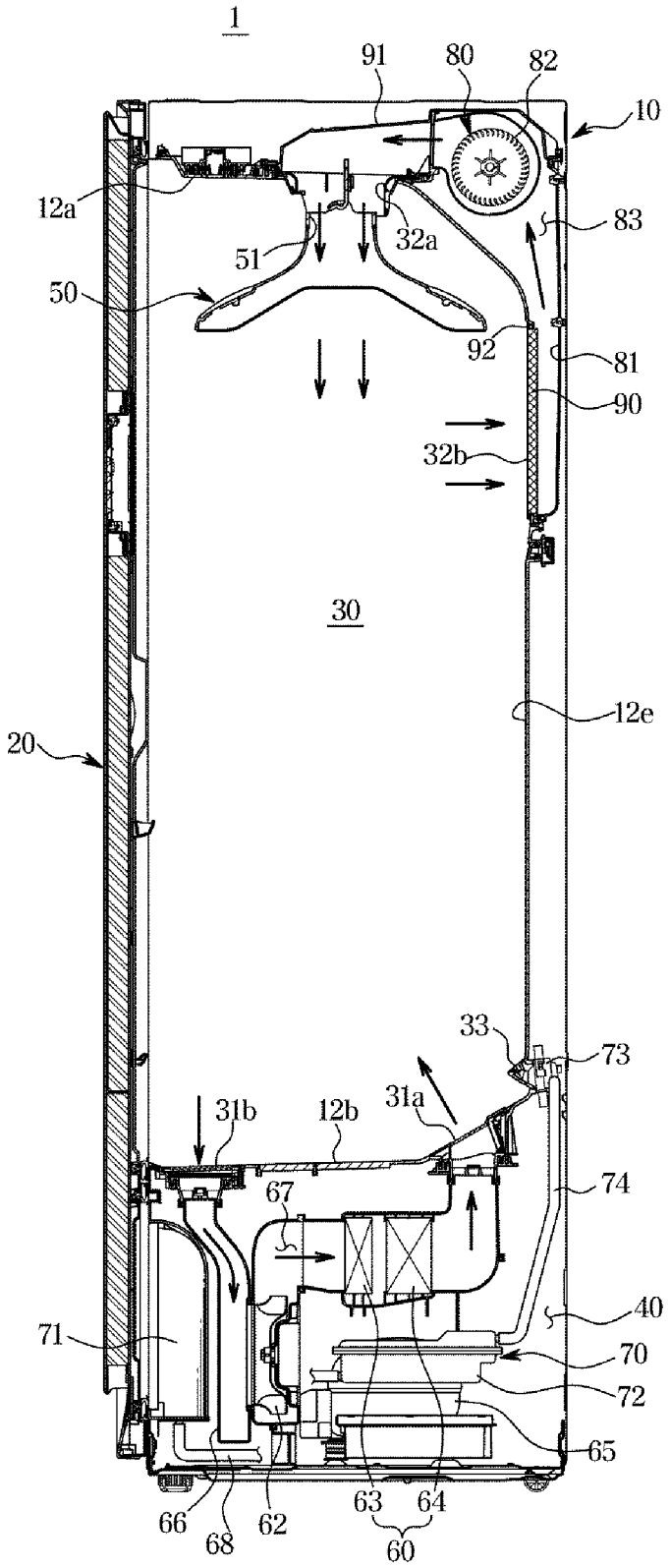
FIG. 3 is a side cross-sectional view of a clothes care apparatus according to an embodiment of the disclosure.
Figure 4:
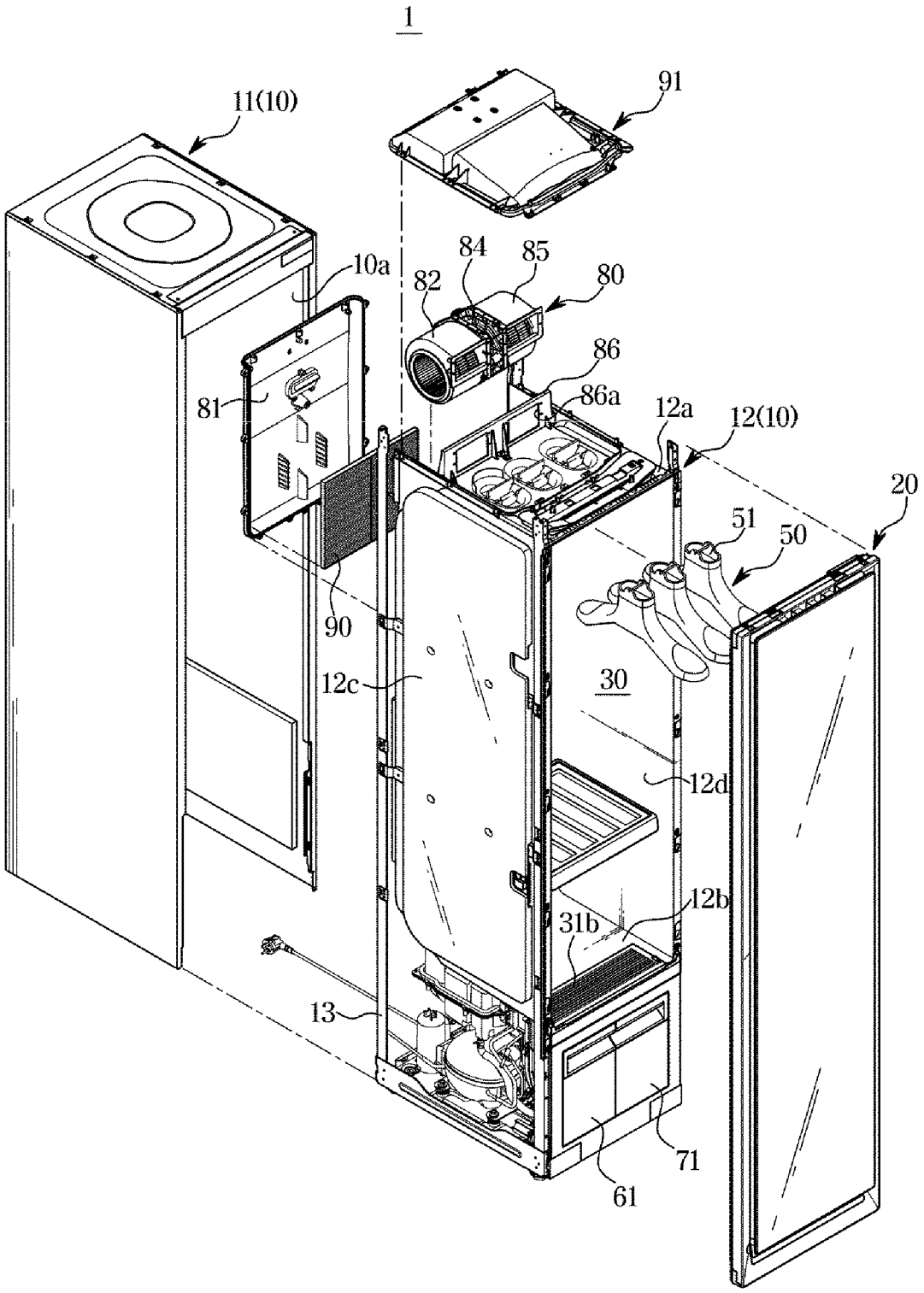
FIG. 4 is an exploded perspective view of a clothes care apparatus according to an embodiment of the disclosure.

FIG. 3 is a side cross-sectional view of a clothes care apparatus according to an embodiment of the disclosure. FIG. 4 is an exploded perspective view of a clothes care apparatus according to an embodiment of the disclosure.

As shown in FIGS. 3 and 4, the main body 10 may include an external cabinet 11, and an internal cabinet 12 positioned inside the external cabinet 11. The main body 10 may include a support member 50 provided inside the care room 30 to hang clothes.

The main body 10 may include a machine room 40 where a heat exchanger 60, etc. for dehumidifying or heating inside air of the care room 30 is accommodated.

The care room 30 may form a space where clothes are accommodated. The care room 30 may be defined by a top plate 12*a*, a bottom plate 12*b*, a left plate 12*c*, a right plate 12*d*, and a rear plate 12*e* of the internal cabinet 12.

The internal cabinet 12 may include a frame 13 supporting the top plate 12*a*, the bottom plate 12*b*, the left plate 12*c*, the right plate 12*d*, and the rear plate 12*e*.

The frame 13 may form the care room 30 and the machine room 40 positioned below the care room 30, although not limited thereto.

The support member 50 may be installed in the top plate 12*a* of the care room 30. The support member 50 may be separable from the care room 30. At least one support member 50 may be provided. The support member 50 may be formed in a shape of a hanger to hang clothes, although not limited thereto.

The support member 50 may make air flow to the inside. Dust or foreign materials attached to clothes may be removed by air supplied to the inside of the support member 50.

In the support member 50, an air hole 51 may be formed to supply air to the clothes. The air hole 51 may be formed at a top end of the support member 50, so that air may be supplied to the clothes through the air hole 51, although not limited thereto.

However, the air hole 51 may be formed with various sizes at various locations to spray supplied air to clothes over a wide area.

The care room 30 may include a first inlet 31*a*, a second inlet 32*a*, a first outlet 31*b*, a second outlet 32*b*, and a steam inlet 33.

The first inlet 31*a* and the first outlet 31*b* may be formed in the bottom plate 12*b* of the care room 30. The first inlet 31*a* may be positioned in a rear area of the bottom plate 12*b* of the care room 30. The first outlet 31*b* may be positioned in a front area of the bottom plate 12*b* of the care room 30. The first inlet 31*a* may be adjacent to the first outlet 31*b*.

The steam inlet 33 may be formed in a lower area of the rear plate 12*e* of the care room 30. The steam inlet 33 may be positioned above the first inlet 31*a*.

The second inlet 32*a* may be formed above the top plate 12*a* of the care room 30. The second outlet 32*b* may be formed in a center of the rear plate 12*e* of the care room 30. The second inlet 32*a* may be adjacent to the second outlet 32*b*.

The second inlet 32*a* of the care room 30 may be connected to the support member 50. Air entered through the second inlet 32*a* may be transferred to the support member 50 through the air hole 51 and transferred to clothes hanging on the support member 50.

In a lower portion of the main body 10, a drain container 61 and a water supply container 71 that are separable from the main body 10 may be installed. The drain container 61 and the water supply container 71 may be positioned below the care room 30.

The drain container 61 may be configured to easily remove condensed water generated by the heat exchanger 60. The water supply container 71 may store water required by a steam generator 70 to generate steam.

Water stored in the water supply container 71 may be supplied to the steam generator 70 and used to generate steam. The water supply container 71 may be separable from the main body 10 to easily add water.

The drain container 61 and the water supply container 71 may be positioned in a front side of the machine room 40. The machine room 40 may be positioned in the lower portion of the main body 10. The machine room 40 may be positioned below the care room 30.

A plurality of hoses 68 may be provided, and the plurality of hoses 68 may be used in the heat exchanger 60 or the steam generator 70.

The heat exchanger 60 may dehumidify or heat inside air of the care room 30 as necessary.

The heat exchanger 60 may supply hot air to the inside of the care room 30. The heat exchanger 60 may include an evaporator 63, a condenser 64, and a compressor 65 through which refrigerants circulate to dehumidify and heat air.

When refrigerants are evaporated in the evaporator 63 of the heat exchanger 60, the refrigerants may absorb latent heat of ambient air to condense water in the air and remove the water.

When refrigerants are condensed in the condenser 64 via the compressor 65, the refrigerants may emit latent heat toward ambient air to thereby heat the ambient air.

Because the evaporator 63 and the condenser 64 perform a heat exchange function, air entered the machine room 40 by a first fan 62 may pass through the evaporator 63 and the condenser 64 sequentially to be dehumidified and heated.

The heat exchanger 60 installed in the machine room 40 may include a first duct 66 connecting the evaporator 63, the condenser 64, and the first fan 62, and the first duct 66 may be connected to the care room 30 to form a first flow path 67 for circulating air between the care room 30 and the first duct 66.

The first duct 66 may be connected to the first inlet 31*a* and the first outlet 31*b* of the care room 30. One end of the first duct 66 may be connected to the first inlet 31*a*, and the other end of the first duct 66 may be connected to the first outlet 31*b*.

Air of the care room 30 may enter the first duct 66 through the first outlet 31*b*, and the air may be dehumidified and again enter the care room 30 through the first inlet 31*a*.

The first inlet 31*a* may be positioned in a rear area of the care room 30, and the first outlet 31*b* may be positioned in a front area of the care room 30, although not limited thereto. The first inlet 31*a* and the first outlet 31*b* may be positioned at other locations as necessary.

The first duct 66 may dehumidify air entered through the first outlet 31*b* and discharge the dehumidified air through the first inlet 31*a*. The first fan 62 may be positioned on the first duct 66 to inhale air of the care room 30 to an inside of the first duct 66.

In the machine room 40, the steam generator 70 may be provided to receive water from the water supply container 71 and generate steam.

The steam generator 70 may be connected to the water supply container 71 to receive water and generate steam, and include a steam supply pipe 74 for guiding the generated steam to a steam spray 73. The steam spray 73 may be positioned at the lower area of the rear plate 12*e* of the care room 30.

One end of the steam spray 73 may be formed in a shape of a nozzle to smoothly spray steam into an inside space of the care room 30, and may be exposed to the inside of the care room 30.

The care room 30 may include a blower 80 to make inside air of the care room 30 flow. The blower 80 may include a second duct 81, and a second fan 82 may be installed inside the second duct 81.

The second duct 81 may communicate with the care room 30 to form a second flow path 83 for circulating air between the care room 30 and the second duct 81. The second fan 82 may be positioned on the second flow path 83.

The second duct 81 may be formed behind the second outlet 32*b* of the care room 30. The second duct 81 may be provided in an upper area of the rear plate 12*e* of the care room 30, and include a filter 90 therein.

The filter 90 may be a High Efficiency Particulate Air (HEPA) filter, although not limited thereto.

The second duct 81 may be coupled to a top cover 91 positioned above the care room 30. The blower 80 may be positioned in an upper and rear area of the care room 30, and include a motor 84 for generating a rotation force, and at least one second fan 82 that rotates by the motor 84.

A shaft of the motor 84 may protrude at its both sides, and the second fan 82 may be coupled to each of both ends of the shaft. Through such a structure, the motor 84 may rotate a pair of second fans 82.

Each of the second fans 82 may be a centrifugal fan for inhaling air in an extension direction of the shaft and discharging the air outward in a radial direction, although not limited thereto.

The second fan 82 may be accommodated in a fan case 85. The fan case 85 may be coupled to a duct bracket 86 provided on the top plate 12*a* of the care room 30.

In the duct bracket 86, at least one duct hole 86*a* may be formed, and the second fan 82 may be coupled to the at least one duct hole 86*a* to move air of the second duct 81 to the second inlet 82*a*.

The second duct 81 may be connected to the second inlet 32*a* and the second outlet 32*b* of the care room 30. One end of the second duct 81 may be connected to the second inlet 32*a*, and the other end of the second duct 81 may be connected to the second outlet 32*b* of the care room 30.

The second inlet 32*a* may be connected to the support member 50 to transfer air of the second duct 81 to the support member 50.

The second fan 82 installed inside the second duct 81 may inhale inside air of the care room 30 through the second outlet 32*b* and discharge the inhaled air through the second inlet 32*a*.

In the rear plate 12*e* of the care room 30, a filter installing portion 92 may be provided to install the filter 90. The second outlet 32*b* may be formed at a location corresponding to the filter installing portion 92.

Inside air of the care room 30 may be, when entering the second duct 81, filtered by the filter 90 installed at the second outlet 32*b*. The filter 90 may remove dust and smell from air that enters the second duct 81.

The air filtered by the filter 90 may be discharged to the support member 50 through the blower 80. The filter 90 may include a dust collecting filter (not shown) for removing dust, or a deodorizing device.

A user may operate the care room 30 for caring clothes after hanging the clothes on the support member 50 and closing the door 20. In the care room 30, air may circulate along the first flow path 67 and the second flow path 83.

Figure 5:
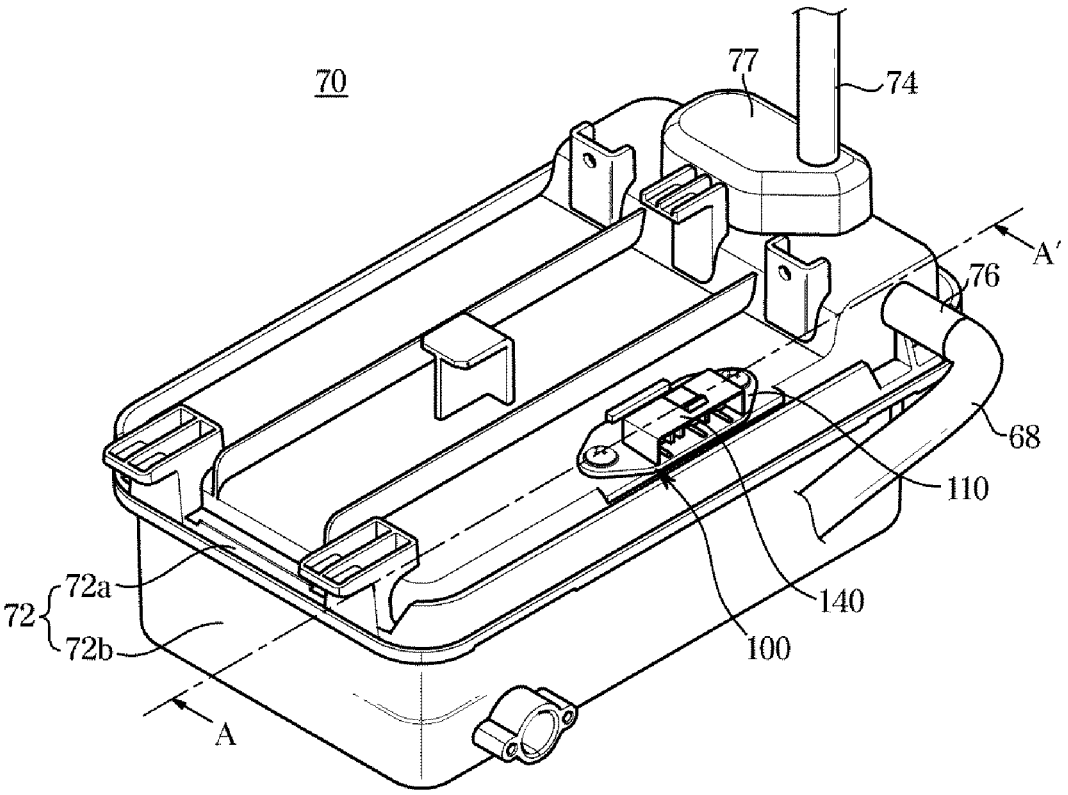
FIG. 5 is a perspective view of a steam generator in a clothes care apparatus according to an embodiment of the disclosure.
Figure 6:
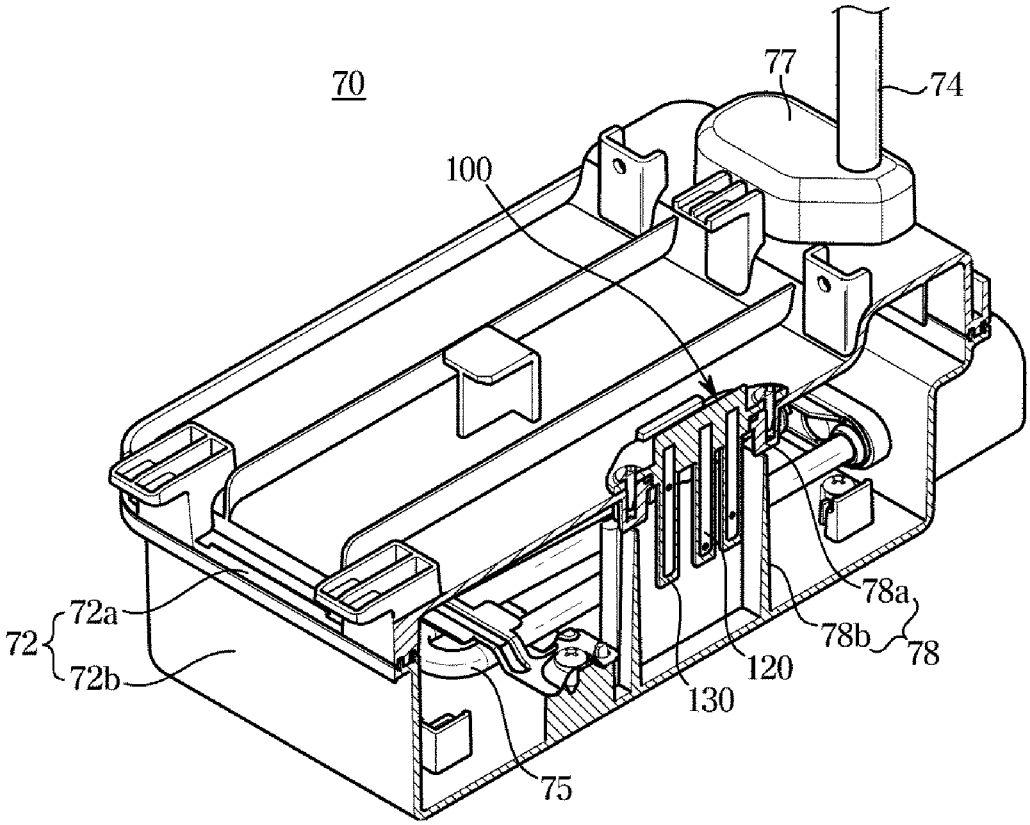
FIG. 6 is a cross-sectional view of the steam generator taken along line A-A' of FIG. 5, in a clothes care apparatus according to an embodiment of the disclosure.
Figure 7:
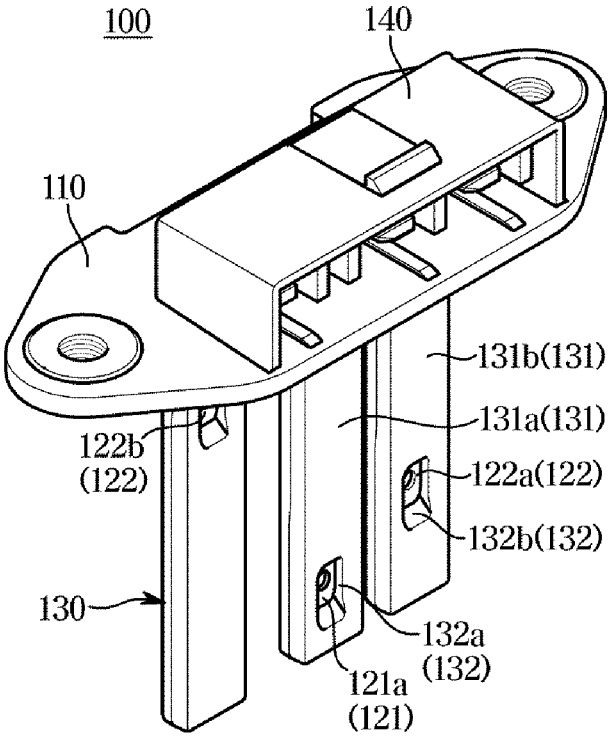
FIG. 7 is a perspective view of a water level sensor in a clothes care apparatus according to an embodiment of the disclosure.
Figure 8:
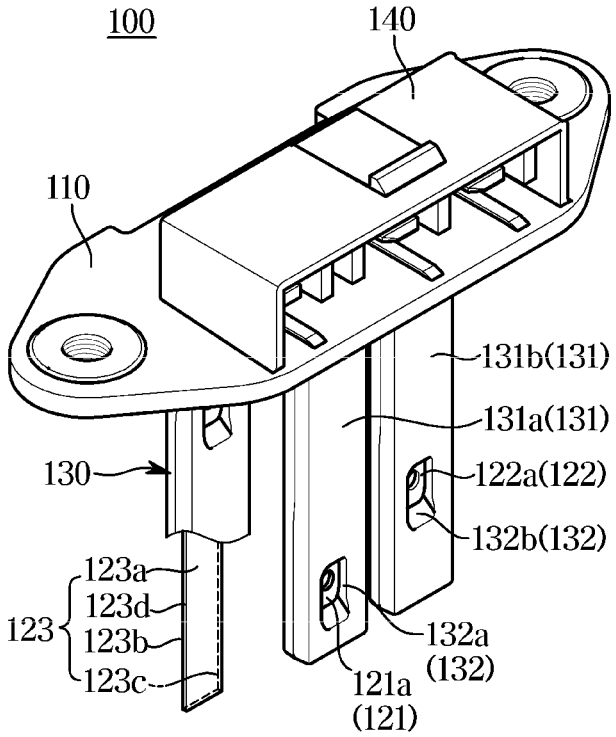
FIG. 8 shows an electrode positioned inside an electrode membrane in a clothes care apparatus according to an embodiment of the disclosure.

FIG. 5 is a perspective view of a steam generator in a clothes care apparatus according to an embodiment of the disclosure. FIG. 6 is a cross-sectional view of the steam generator taken along line A-A' of FIG. 5, in a clothes care apparatus according to an embodiment of the disclosure. FIG. 7 is a perspective view of a water level sensor in a clothes care apparatus according to an embodiment of the disclosure. FIG. 8 shows an electrode positioned inside an electrode membrane in a clothes care apparatus according to an embodiment of the disclosure.

As shown in FIGS. 5 to 8, the steam generator 70 may include a case 72 for storing water, and a heater 75 positioned inside the case 72 to heat water stored in the case 72.

The case 72 may receive water from the water supply container 71 (see FIG. 3) through the hose 68 (see FIG. 3).

The case 72 may include a lower case 72*b* in which water is stored, and a upper case 72*a* removably coupled to a upper portion of the lower case 72*b*.

The case 72 may have a capacity to store a preset amount of water. The case 72 may have a nearly rectangular parallelopiped shape, although not limited thereto.

The heater 75 may be adjacent to a bottom plate of the case 72 to heat water regardless of a high or low level of water stored in the case 72. The heater 75 may be installed on a bottom of the lower case 72*b*, and when water is supplied to the lower case 72*b*, the heater 75 may directly heat the water in a state of being completely under the water.

The heater 75 may be a sheath heater having high heat efficiency and capable of heating water within a relatively short time, although not limited thereto. For example, the heater 75 may be a coil heater located outside the case 72 and configured to heat water stored in the case 72.

The upper case 72*a* may include a water supply portion 76 connected to the hose 68, and a discharge portion 77 connected to the steam supply pipe 74 for supplying steam generated by heating water entered the case 72 through the heater 75 to the care room 30 (see FIG. 4).

The case 72 may include a temperature sensor (not shown) for measuring temperature of water stored in the case 72, and the heater 75 may include a heater temperature sensor (not shown) such as a thermo-fuse for preventing the heater 75 from being damaged by overheating, although not limited thereto.

In the upper case 72*a*, a water level sensor 100 for measuring a water level of water stored in the case 72 may be installed.

The water level sensor 100 may be connected to a controller (not shown) to add water when a water level of water stored in the case 72 is lower than a reference value and stop, when a water level of water stored in the case 72 is higher than the reference value, supplying water and drive the heater 75 to generate steam.

The water level sensor 100 may include an electrode 120 extending toward the bottom of the lower case 72*b*, and a housing 110 supporting the electrode 120 and removably coupled to the upper case 72*a*.

The housing 110 may be fixed on an outer surface of the upper case 72*b* by a bolt, etc., and a socket 140 for electrically connecting to an outside of the housing 110 may be provided on an upper surface of the housing 110.

The electrode 120 may be installed at an appropriate height from the bottom of the lower case 72*b* to sense a water level of water stored in the case 72.

In the socket 140 of the water level sensor 100, a connector (not shown) connecting the electrode 120 to the controller (not shown) of the clothes care apparatus 1 (see FIG. 4) may be inserted.

The socket 140 may be positioned on the upper surface of the housing 110. The socket 140 may be exposed outside the case 72, although not limited thereto.

The water level sensor 100 may include an electrode membrane 130 surrounding an outer surface of the electrode 120. A plurality of electrodes 120 may be provided, and accordingly, a plurality of electrode membranes 130 and a plurality of sockets 140 may be provided to correspond to the plurality of electrodes 120.

When water is supplied to the inside of the case 72, at least one of the electrodes 120 may convey electricity by the water, and the controller (not shown) may sense the electricity to measure a water level of the water supplied to the inside of the case 72.

The housing 110, the socket 140, and the electrode membrane 130 may be integrated into one body. That is, the housing 110, the socket 140, and the electrode membrane 130 may be integrated into one body through insert-molding with the electrode 120.

That is, after the electrode 120 is manufactured, the socket 140, the housing 110, and the electrode membrane 130 may be insert-molded into the electrode 120, thereby being formed as one body. The socket 140, the housing 110, and the electrode membrane 130 except for the electrode 120 may have insulating properties, and may be made of a resin material to facilitate insert-molding.

Accordingly, the water level sensor 100 may be assembled into the case 72 simply by installing the water level sensor 100 on the upper surface of the case 72, because the water level sensor 100 is formed as a single component through insert-molding. Therefore, an assembly process may be simplified, which contributes to a productivity improvement. The electrode 120 may be made of a conductive material through which current flows.

In the inside of the case 72, a plurality of diaphragms 78 including a upper diaphragm 78*a* and a lower diaphragm 78*b* may be positioned around the electrode 120. The lower diaphragm 76*b* may protrude upward from the bottom of the lower case 72*b* to be adjacent to the electrode 120.

The upper diaphragm 78*a* may protrude downward from the upper case 72*a* to be adjacent to the electrode 120, like the lower diaphragm 78*b*.

Although not shown in the drawings, a communicating slit (not shown) may be formed between side walls of the case 72 and the diaphragms 78 such that water stored in the case 72 is filled in an inside space of the diaphragms 78.

Around the electrode 120, a substantially independent space may be formed by the diaphragms 78. Accordingly, although water stored in the case 72 is slopping when water is supplied to the inside of the case 72 or due to vibration, etc. transferred from the outside, the slopping of the water may be reduced in the inside space defined by the diaphragms 78 so that the water level sensor 100 may accurately sense a water level.

A plurality of electrodes 120 may be provided. The plurality of electrodes 120 may have the same length. Accordingly, the number of components may be reduced, and the plurality of electrodes 120 may be shared.

The plurality of electrodes 120 may include a first electrode 121, and a second electrode 122 being adjacent to the first electrode 121.

The first electrode 121 may be a common electrode 121*a*, and the second electrode 122 may include a low water level electrode 122*a* configured to sense a low water level of water stored in the case 72 and a high water level electrode 122*b* configured to sense a high water level of water stored in the case 72.

The common electrode 121*a* may extend close to the bottom of the case 72 to contact water until water stored in the case 72 is exhausted. The low water level electrode 122*a* may be electrically connected to the common electrode 121*a* until water stored in the case 72 is exhausted.

The low water level electrode 122*a* may sense a minimum water level for preventing overheating of the heater 75.

The low water level electrode 122*a* may have a position of contacting water stored in the case 72 to prevent a fire from occurring when the heater 75 is exposed above a surface of the water stored in the case 71 due to a slope of a place where the steam generator 70 is placed.

The low water level electrode 122*a* may be positioned above the heater 75. One end of the low water level electrode 122*a* may be supported by the housing 110, and the other end of the low water level electrode 122*a* may be positioned above the heater 75 and spaced from the heater 75.

The high water level electrode 122*b* may have a position of contacting water stored in the case 72 to prevent water from overflowing from the case 72 when water is supplied to the inside of the case 72 to exceed a high water level.

Hereinafter, an operation principle of the water level sensor 100 of the steam generator 70 will be described in detail.

First, water may enter the inside of the case 72 through the water supply portion 76, and the water entered the inside of the case 72 may be heated by the heater 75 to be converted into steam.

The steam may enter the care room 40 (see FIG. 4) through the discharge portion 77 of the case 72.

When water is fully filled in the case 71 to reach a full water level, all the common electrode 121*a*, the low water level electrode 122*a*, and the high water level electrode 122*b* may be under the water to convey electricity, so that the controller (not shown) may determine a high water level.

When the water stored in the case 72 is consumed to become about an intermediate water level, the high water level electrode 122*b* may be exposed above a surface of the water to convey no electricity to the common electrode 121*a* and the low water level electrode 122*a* and the common electrode 121*a* may be under the water to convey electricity, so that the controller (not shown) may determine a low water level.

When the water stored in the case 71 is nearly exhausted to be below the low water level, all the common electrode 121*a* and the low water level electrode 122*a* may be exposed to air to convey no electricity.

The electrode membrane 130 may include an electrode membrane body 131 surrounding the electrode 120, and an electrode hole 132 formed in the electrode membrane body 131 to expose the electrode 120 to an outside of the electrode membrane body 131.

One end of the electrode membrane 130 may be connected to the housing 110 to be integrated into the housing 110, and the other end of the electrode membrane 130 may be spaced from the bottom of the case 72. The electrode hole 132 may be positioned between one end of the electrode membrane body 131 and the other end of the electrode membrane body 131.

Accordingly, because one end of the electrode 120 is surrounded by the electrode membrane body 131, the water level sensor 100 may be prevented from wrongly sensing a water level even when water stored in the case 72 is slopping.

A position of a portion of the first electrode 121 exposed to the outside of the electrode membrane body 131 through the electrode hole 132 may be different from that of a portion of the second electrode 122 exposed to the outside of the electrode membrane body 131 through the electrode hole 132.

The electrode membrane body 131 may include a first electrode membrane body 131*a* surrounding the first electrode 121, and a second electrode membrane body 131*b* surrounding the second electrode 122.

The electrode hole 132 may include a first electrode hole 132*a* formed in the first electrode membrane body 131*a* and a second electrode hole 132*b* formed in the second electrode membrane body 131*b*, wherein the second electrode hole 132*b* may be spaced from the bottom of the case 72 by a distance that is different from a distance by which the first electrode hole 132*a* is spaced from the bottom of the case 72.

The distance by which the second electrode hole 132*b* is spaced from the bottom of the case 72 may be longer than the distance by which the first electrode hole 132*a* is spaced from the bottom of the case 72.

A distance by which the low water level electrode 122*a* exposed to the outside of the electrode membrane body 131 through the electrode hole 132 is spaced from the bottom of the case 72 may be longer than a distance by which the common electrode 121*a* exposed to the outside of the electrode membrane body 131 through the electrode hole 132 is spaced from the bottom of the case 72.

That is, a distance by which the electrode hole 132 exposing the low water level electrode 122*a* to the outside of the electrode membrane body 131 is spaced from the bottom of the case 72 may be identical to a distance by which the electrode hole 132 exposing the common electrode 121*a* to the outside of the electrode membrane body 131 is spaced from the bottom of the case 72, although not limited thereto.

The electrode 120 may include a plurality of electrode surfaces 123. At least one of the electrode surfaces 123 may be exposed to the outside of the electrode membrane body 131 through the electrode hole 132.

The electrode membrane body 131 may surround at least one of one surfaces of the first electrode 121 and the second electrode 122, the surfaces of the first electrode 121 and the second electrode 122 facing each other, so that the first electrode 121 is spaced apart from the second electrode 122.

The electrode 120 may have a nearly rectangular parallelopiped shape, although not limited thereto. The electrode surfaces 123 may include a first surface 123*a*, a second surface 123*b* being opposite to the first surface 123*a*, a third surface 123*c* connecting the first surface 123*a* to the second surface 123*b*, and a fourth surface 123*d* being opposite to the third surface 123*c*.

At least one of the first surface 123*a* or the second surface 123*b* may be exposed to the outside of the electrode membrane body 131 through the electrode hole 132. The first surface 123*a* and the second surface 123*b* may be exposed to the outside of the electrode membrane body 131 through the electrode hole 132. Accordingly, the first surface 123*a* and the second surface 123*b* may contact water stored in the case 72.

At least one of the third surface 123*c* or the fourth surface 123*d* may be surrounded by the electrode membrane body 131. The third surface 123*c* and the fourth surface 123*d* may be surrounded by the electrode membrane body 131 to be prevented from contacting water stored in the case 72.

At least one of edges of the first surface 123*a* or edges of the second surface 123*b* may be surrounded by the electrode membrane body 131. The edges of the first surface 123*a* and the edges of the second surface 123*b* may be surrounded by the electrode membrane body 131.

Accordingly, a portion of the first surface 123*a* of the first electrode 121 exposed to the outside of the first electrode membrane body 131*a* through the first electrode hole 132*a* and a portion of the first surface 123*a* of the second electrode 121 exposed to the outside of the second electrode membrane body 131*b* through the second electrode hole 132*b* may contact water stored in the case 72.

To space apart the first electrode 121 from the second electrode 122, at least one of the third surface 123*c* of the first electrode 121 or the fourth surface 123*d* of the second electrode 122, the third surface 123*c* of the first electrode 121 facing the fourth surface 123*d* of the second electrode 122, may be surrounded by the electrode membrane body 131.

Accordingly, the electrodes 120 may be prevented from corroding due to electrolysis caused by a short distance between the electrodes 120.

A lower end of the electrode hole 132 may be inclined. Accordingly, water contacting the electrodes 120 through the electrode hole 132 may flow down toward the inside of the case 72 without being collected in the electrode hole 132.

Figure 9:
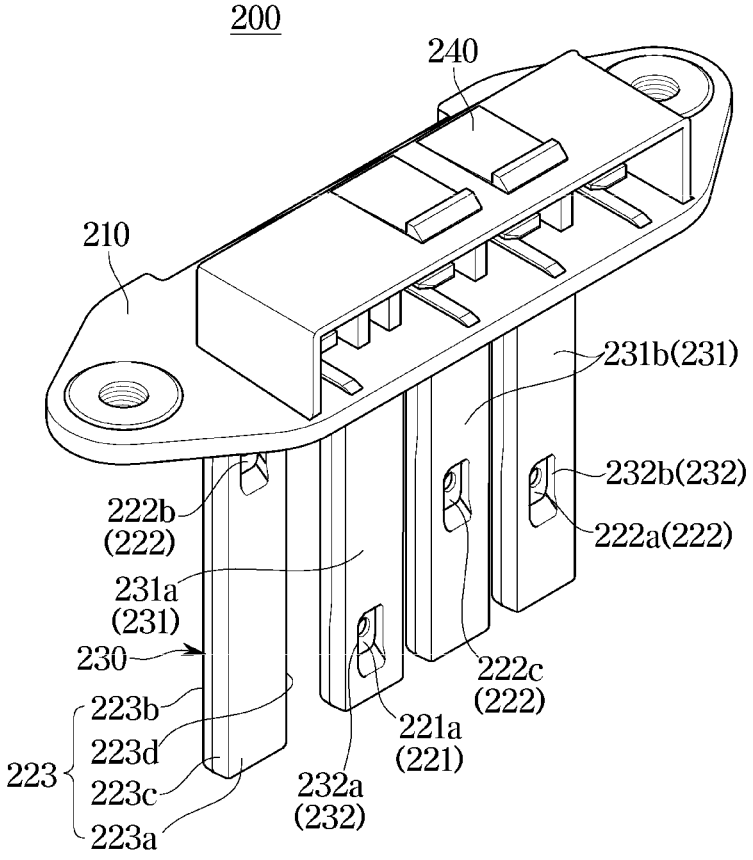
FIG. 9 is a perspective view of a water level sensor in a clothes care apparatus according to another embodiment of the disclosure.

FIG. 9 is a perspective view of a water level sensor in a clothes care apparatus according to another embodiment of the disclosure. A water level sensor 200 according to another embodiment of the disclosure may be different from the water level sensor 100 (see FIG. 5) according to an embodiment of the disclosure in view of the number of electrodes 221, 222 and positions of electrode holes 232.

Hereinafter, the water level sensor 200 according to another embodiment of the disclosure will be described based on differences from the water level sensor 100 according to an embodiment of the disclosure.

As shown in FIG. 9, the water level sensor 200 may include an electrode 221 extending toward the bottom of the lower case 72*b* (see FIG. 5), and a housing 210 supporting the electrode 221 and removably coupled to the upper case 72*a* (see FIG. 5).

On the housing 210, a socket 240 for electrically connecting to an external device may be provided.

The water level sensor 200 may include an electrode membrane 230 surrounding an outer surface of the electrode 222. A plurality of electrodes 221, 222 may be provided, and accordingly, a plurality of electrode membranes 230 and a plurality of sockets 240 may be provided to correspond to the plurality of electrodes 221, 222.

The plurality of electrodes may include a first electrode 221, and a second electrode 222 being adjacent to the first electrode 221.

The first electrode 221 may be a common electrode 221*a*, and the second electrode 222 may include a low water level electrode 222*a* configured to sense a low water level of water stored in the case 72 (see FIG. 5) and a high water level electrode 222*b* configured to sense a high water level of water stored in the case 72.

The electrode membrane 230 may include an electrode membrane body 231 surrounding the electrode 221, 222, and an electrode hole 232 formed in the electrode membrane body 231 to expose the electrode 221, 222 to an outside of the electrode membrane body 231.

One end of the electrode membrane 230 may be connected to the housing 210 to be integrated into the housing 210, and the other end of the electrode membrane 230 may be spaced from the bottom of the case 72. The electrode hole 232 may be positioned between one end of the electrode membrane 230 and the other end of the electrode membrane 230.

A position of a portion of the first electrode 221 exposed to the outside of the electrode membrane body 231 through the electrode hole 232 may be different from that of a portion of the second electrode 222 exposed to the outside of the electrode membrane body 231 through the electrode hole 232.

The electrode membrane body 231 may include a first electrode membrane body 231*a* surrounding the first electrode 221, and a second electrode membrane body 231*b* surrounding the second electrode 222.

The electrode hole 232 may include a first electrode hole 232*a* formed in the first electrode membrane body 231*a* and a second electrode hole 232*b* formed in the second electrode membrane body 231*b*, wherein the second electrode hole 232*b* may be spaced from the bottom of the case 72 by a distance that is different from a distance by which the first electrode hole 232*a* is spaced from the bottom of the case 72.

Similar to the electrode surfaces illustrated in FIG. 8, the electrode 221, 222 may include a plurality of electrode surfaces 223. At least one of the electrode surfaces 223 may be exposed to the outside of the electrode membrane body 231 through the electrode hole 232.

The electrode 221, 222 may have a nearly rectangular parallelopiped shape, although not limited thereto. The electrode surfaces 223 of electrode 221, 222, similar to the electrode surfaces illustrated in FIG. 8, may include a first surface 223*a*, a second surface 223*b* being opposite to the first surface 223*a*, a third surface 223*c* connecting the first surface 223*a* to the second surface 223*b*, and a fourth surface 223*d* being opposite to the third surface 223*c*.

The second electrode 222 may include an intermediate water level electrode 222*c* exposed to the outside of the electrode membrane body 231 through the electrode hole 231 between a distance by which the low water level electrode 222*a* exposed to the outside of the electrode membrane body 231 is spaced from the bottom of the case 72 and a distance by which the high water level electrode 222*b* exposed to the outside of the electrode membrane body 231 is spaced from the bottom of the case 72.

Because the high water level electrode 222*b* and the intermediate water level electrode 222*c* are exposed at different positions to the outside of the second electrode membrane body 231*b* through the second electrode hole 232*b*, an energy consumption amount of the clothes care apparatus 1 (see FIG. 1) may be reduced.

For example, it is assumed that the high water level electrode 222*b* senses an operation of a sterilization course, the intermediate water level electrode 222*c* senses an operation of a standard course, and the high water level electrode 222*b* and the intermediate water level electrode 222*c* are exposed at the same position to the outside of the second electrode membrane body 231*b* through the second electrode hole 232*b*. In this case, even when the standard course operates, water may need to be supplied to the inside of the case 72 up to the portion of the high water level electrode 222*b* exposed to the outside of the second electrode membrane body 231*b* through the second electrode hole 232*b*, so that an amount of water to be boiled to generate steam may increase, resulting in an increase of an energy consumption amount.

Figure 10:
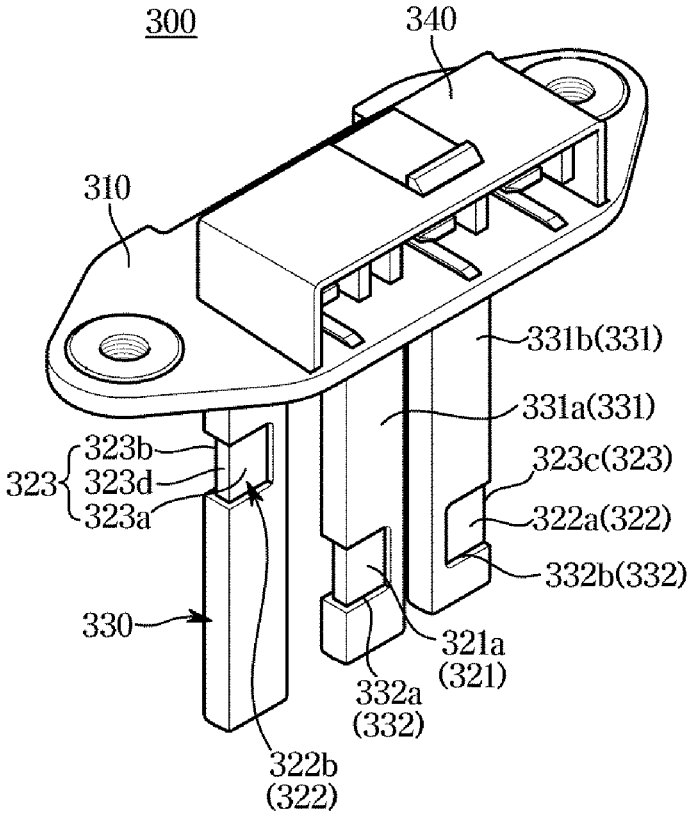
FIG. 10 is a perspective view of a water level sensor in a clothes care apparatus according to still another embodiment of the disclosure.

FIG. 10 is a perspective view of a water level sensor in a clothes care apparatus according to still another embodiment of the disclosure. A water level sensor 300 according to another embodiment of the disclosure may be different from the water level sensor 100 (see FIG. 5) according to an embodiment of the disclosure in view of a shape of an electrode hole 332.

Hereinafter, the water level sensor 300 according to another embodiment of the disclosure will be described based on a difference from the water level sensor 100 according to an embodiment of the disclosure.

As shown in FIG. 10, the water level sensor 300 may include an electrode 321, 322 extending toward the bottom of the lower case 72*b* (see FIG. 5), and a housing 310 supporting the electrode 321, 322 and removably coupled to the upper case 72*a* (see FIG. 5).

On the housing 310, a socket 340 for electrically connecting to an external device may be provided.

The water level sensor 300 may include an electrode membrane 330 surrounding an outer surface of the electrode 322. A plurality of electrodes 321, 322 may be provided, and accordingly, a plurality of electrode membranes 330 and a plurality of sockets 340 may be provided to correspond to the plurality of electrodes 321, 322.

The plurality of electrodes may include a first electrode 321, and a second electrode 322 being adjacent to the first electrode 321.

The first electrode 321 may be a common electrode 321*a*, and the second electrode 322 may include a low water level electrode 322*a* configured to sense a low water level of water stored in the case 72 (see FIG. 5) and a high water level electrode 322*b* configured to sense a high water level of water stored in the case 72.

The electrode membrane 330 may include an electrode membrane body 331 surrounding the electrode 322, and an electrode hole 332 formed in the electrode membrane body 331 to expose the electrode 322 to an outside of the electrode membrane body 331.

One end of the electrode membrane 330 may be connected to the housing 310 to be integrated into the housing 310, and the other end of the electrode membrane 130 may be spaced from the bottom of the case 72. The electrode hole 332 may be positioned between one end of the electrode membrane 330 and the other end of the electrode membrane 330.

A position of a portion of the first electrode 321 exposed to the outside of the electrode membrane body 331 through the electrode hole 332 may be different from that of a portion of the second electrode 322 exposed to the outside of the electrode membrane body 331 through the electrode hole 332.

The electrode membrane body 331 may include a first electrode membrane body 331*a* surrounding the first electrode 321, and a second electrode membrane body 331*b* surrounding the second electrode 322.

The electrode hole 332 may include a first electrode hole 332*a* formed in the first electrode membrane body 331*a* and a second electrode hole 332*b* formed in the second electrode membrane body 331*b*, wherein the second electrode hole 332*b* may be spaced from the bottom of the case 72 by a distance that is different from a distance by which the first electrode hole 332*a* is spaced from the bottom of the case 72.

The electrode 322 may include a plurality of electrode surfaces 323. At least one of the electrode surfaces 323 may be exposed to the outside of the electrode membrane body 331 through the electrode hole 332.

The electrode 322 may have a nearly rectangular parallelopiped shape, although not limited thereto. The electrode surfaces 323 may include a first surface 323*a*, a second surface 223*b* being opposite to the first surface 323*a*, a third surface 323*c* connecting the first surface 323*a* to the second surface 323*b*, and a fourth surface 323*d* being opposite to the third surface 323*c*.

The electrode hole 332 may be formed in the electrode membrane body 331 to expose at least one of one surface of the first electrode 321 or one surface of the second electrode 322 to the outside of the electrode membrane body 331.

That is, at least one of the fourth surface 323*d* of the first electrode 321 or the third surface 332*c* of the second electrode 322 may be exposed to the outside of the electrode membrane body 331 through the electrode hole 332. The fourth surface 323*d* of the first electrode 321 and the third surface 332*c* of the second electrode 322 may be exposed to the outside of the electrode membrane body 331 through the electrode hole 332.

The third surface 323*c* of the first electrode 321 and the fourth surface 323*d* of the second electrode 322 may be surrounded by the electrode membrane body 331. That is, the third surface 323*c* of the first electrode 321 and the fourth surface 323*d* of the second electrode 322 that faces the third surface 323*c* of the first electrode 321 may be not exposed to the outside, and a distance between a portion of the first electrode 321 exposed to the outside and a portion of the second electrode 322 exposed to the outside may increase.

Accordingly, the water level sensor 300 may be prevented from a wrong operation that may be caused by a short distance between the first electrode 321 and the second electrode 322.

A lower end of the electrode hole 332 may be inclined. Accordingly, water contacting the electrodes 322 through the electrode hole 332 may flow down toward the inside of the case 72 without being collected in the electrode hole 332.

By insert-molding the electrode membranes to surround the ends of the electrodes, a water level may be prevented from being wrongly sensed even when water stored in the case is slopping.

By spacing apart the plurality of electrodes from each other, the plurality of electrodes may be prevented from corroding due to electrolysis between the plurality of electrodes.

By matching the lengths of the plurality of electrodes, the number of components may be reduced and the plurality of electrodes may be shared.

Although the technical idea of the disclosure has been described above with reference to specific embodiments, the scope of rights of the disclosure is not limited to these embodiments.

It will be understood by those skilled in the art that various changes in form and details may be made therein without departing from the spirit and scope of the disclosure as defined by the appended claims and their equivalents.

What is claimed is:

1. A clothes care apparatus comprising:

a main body including a care room to accommodate clothes;

a machine room provided inside the main body and positioned below the care room; and a steam generator positioned inside the machine room, and including a case and a water level sensor configured to sense a level of water stored in the case, wherein the water level sensor comprises:

a housing coupleable to and decoupleable from the case;

a plurality of electrodes supported by the housing and having a same length; and an electrode membrane including an electrode membrane body respectively surrounding each of the plurality of electrodes, and an electrode hole formed on the electrode membrane body between an upper end of the electrode membrane and a lower end of the electrode membrane to respectively expose the plurality of electrodes to an outside of the electrode membrane body, wherein the electrode hole is among electrode holes of the plurality of electrodes formed to face away from a bottom of the case whereby the electrode holes are spaced from a lower end of a respective electrode membrane body and the electrode holes are respectively positioned at different heights relative to the bottom of the case, wherein a lower end of the electrode hole is formed to be downwardly inclined.

2. The clothes care apparatus of claim 1, wherein one end of the electrode membrane is connected to and integrated with the housing, and another end of the electrode membrane is spaced apart from the bottom of the case.

3. The clothes care apparatus of claim 1, wherein each of the plurality of electrodes comprises a first surface, a second surface opposite the first surface, a third surface connecting the first surface to the second surface, and a fourth surface being opposite to the third surface, and at least one of the first surface or the second surface is exposed to the outside of the electrode membrane body through the electrode hole.

4. The clothes care apparatus of claim 3, wherein at least one of the third surface or the fourth surface is surrounded by the electrode membrane body.

5. The clothes care apparatus of claim 3, wherein at least one of edges of the first surface or edges of the second surface is surrounded by the electrode membrane body.

6. The clothes care apparatus of claim 1, wherein the plurality of electrodes comprises a first electrode, and a second electrode that is adjacent to the first electrode, and a position of a portion of the first electrode that is exposed is different from a position of a portion of the second electrode exposed.

7. The clothes care apparatus of claim 6, wherein the electrode membrane body is a first electrode membrane body surrounding the first electrode, and the electrode membrane includes a second electrode membrane body surrounding the second electrode, and the electrode hole is a first electrode hole formed in the first electrode membrane body and the electrode membrane includes a second electrode hole formed in the second electrode membrane body, wherein the second electrode hole is spaced apart from the bottom of the case by a distance that is different from a distance by which the first electrode hole is spaced apart from the bottom of the case.

8. The clothes care apparatus of claim 6, wherein at least one of a surface of the first electrode or a surface of the second electrode, the surface of the first electrode being opposite to the surface of the second electrode, is formed to space apart the first electrode from the second electrode.

9. The clothes care apparatus of claim 6, wherein at least one of a surface of the first electrode or a surface of the second electrode is exposed to the outside.

10. The clothes care apparatus of claim 6, wherein the first electrode comprises a common electrode, and the second electrode comprises a low water level electrode configured to sense a low water level of water stored in the case and a high water level electrode configured to sense a high water level of water stored in the case.

11. The clothes care apparatus of claim 10, wherein a distance by which the low water level electrode is spaced apart from the bottom of the case is longer than a distance by which the common electrode is spaced apart from the bottom of the case.

12. The clothes care apparatus of claim 10, wherein the low water level electrode is positioned above a heater configured to heat water stored in the case.

13. The clothes care apparatus of claim 10, wherein the second electrode further comprises:

an intermediate water level electrode including a respective electrode hole through which the intermediate water level electrode is exposed to an outside of a respective electrode membrane body between a first electrode hole through which the low water level electrode is exposed to an outside of a first electrode membrane body and a second electrode hole through which the high water level electrode is exposed to an outside of a second electrode membrane body.

14. The clothes care apparatus of claim 1, wherein the housing and the electrode membrane are integrated into one body through insert-molding with the plurality of electrodes.

15. A clothes care apparatus comprising:

a main body including a care room;

a machine room positioned below the care room; and a steam generator positioned inside the machine room, wherein the steam generator comprises:

a case; and a water level sensor including:

a housing coupleable to and detachable from the case, a plurality of electrodes configured to sense a level of water stored in the case and having a same length, wherein one respective end of the plurality of electrodes is supported by the housing, an electrode membrane body respectively surrounding each of the plurality of electrodes, and an electrode hole formed on the electrode membrane body between an upper end of the electrode membrane and a lower end of the electrode membrane to respectively expose the plurality of electrodes to an outside of the electrode membrane body, wherein one end of the electrode membrane is connected to the housing and another end of the electrode membrane is spaced apart from a bottom of the case, wherein the electrode hole is among electrode holes of the plurality of electrodes formed to face away from the bottom of the case whereby the electrode holes are respectively positioned at different heights relative to the bottom of the case, wherein a lower end of the electrode hole is formed to be downwardly inclined.

16. The clothes care apparatus of claim 15, wherein the plurality of electrodes comprises a first electrode, and a second electrode that is adjacent to the first electrode, and a position of the first electrode that is exposed is different from a position of the second electrode exposed.

17. The clothes care apparatus of claim 16, wherein the first electrode comprises a common electrode, and the second electrode comprises a low water level electrode configured to sense a low water level of water stored in the case, a high water level electrode configured to sense a high water level of water stored in the case, and an intermediate water level electrode exposed to an outside of a respective electrode membrane body between a first electrode hole through which the low water level electrode is exposed to the outside of a second electrode membrane body and a second electrode hole through which the high water level electrode is exposed to an outside of a second electrode membrane body.

18. A clothes care apparatus comprising:

a main body including a care room to accommodate clothes;

a machine room provided inside the main body and positioned below the care room; and a steam generator positioned inside the machine room, and including a case and a water level sensor configured to sense a level of water stored in the case, wherein the water level sensor comprises:

a housing coupleable to and decoupleable from the case;

a plurality of electrodes supported by the housing and having a same length, and including a first electrode and a second electrode being adjacent to the first electrode; and an electrode membrane including:

an electrode membrane body respectively surrounding at least one cross section of the first electrode or one cross section of the second electrode, one surface of the first electrode being opposite to one surface of the second electrode, to space apart the first electrode from the second electrode, and an electrode hole formed in the electrode membrane body between an upper end of the electrode membrane and a lower end of the electrode membrane and exposing at least one of an opposite cross section of the first electrode or an opposite cross section of the second electrode to an outside of the electrode membrane body, wherein the electrode hole is among electrode holes of the plurality of electrodes formed to face away from a bottom of the case whereby the electrode holes are respectively positioned at different heights relative to the bottom of the case, wherein a lower end of the electrode hole is formed to be downwardly inclined.

* * * * *